United States Patent [19]

Glöyer

[11] 4,133,428

[45] Jan. 9, 1979

[54] SURROUNDING CARTON FOR TRANSPORTING CONTAINERS

[76] Inventor: Wolfgang Glöyer, Wiesenweg 51, D-2000 Oststeinbek, Germany

[21] Appl. No.: 854,231

[22] Filed: Nov. 23, 1977

[30] Foreign Application Priority Data

Dec. 2, 1976 [DE] Fed. Rep. of Germany ... 7637703[U]

[51] Int. Cl.[2] ..... B65D 25/22

[52] U.S. Cl. ..... 206/427; 229/52 BC

[58] Field of Search ..... 229/52 BC; 206/427, 206/431, 434, 526

[56] References Cited

U.S. PATENT DOCUMENTS

| | | | |
|---|---|---|---|
| 2,718,301 | 9/1955 | Palmer | 206/427 |
| 2,785,847 | 3/1957 | Forrer | 206/427 X |
| 2,954,898 | 10/1960 | Freeburg | 206/427 X |
| 3,078,032 | 2/1963 | Robinson et al. | 229/52 B |
| 3,107,007 | 10/1963 | Klein | 206/526 |
| 3,424,301 | 1/1969 | Forrer et al. | 206/431 |
| 3,784,082 | 1/1974 | Hurlock | 206/431 |
| 3,931,888 | 1/1976 | Fogel | 206/434 |
| 4,016,995 | 4/1977 | Frazer | 206/431 X |

*Primary Examiner*—Davis T. Moorhead

*Attorney, Agent, or Firm*—Toren, McGeady and Stanger

[57] ABSTRACT

Surrounding carton for transporting containers, specifically canisters, with the containers each having a base, an end section remote from the base and a handle on the end section. The carton has a base portion, sidewalls and a cover portion forming a space for receiving the containers. An opening is provided through the cover so that a human hand can pass through it to grip the handle on one of the containers. The opening is located centrally in the cover portion and is aligned with the handle of the central container of a plurality of containers present in an odd number within the carton. The opening in the cover portion is arranged eccentrically to the longitudinal axis of the cover portion.

2 Claims, 3 Drawing Figures

SURROUNDING CARTON FOR TRANSPORTING CONTAINERS

BACKGROUND OF THE INVENTION

The invention relates to a surrounding carton for transporting containers, which have a handle on the end section of the container remote from its base. The carton consists of a base portion, sidewalls and a cover portion forming an enclosure for the containers.

BRIEF SUMMARY OF THE INVENTION

The problem of the invention is to provide a surrounding carton for transporting containers each of which has a handle at its end section remote from its base so that the carton can easily be transported by one person and easily stacked on shelves, pallets or the like accompanied by optimum utilisation of the bearing surface.

According to the invention, the problem is solved by providing an opening in the top of the carton through which a human hand can be passed to grip the handle of the of the central container of an old number of containers present in the surrounding carton. In the case of handles constructed eccentrically on the containers, the opening in the cover portion can be positioned eccentrically to the longitudinal axis thereof.

According to a special development of the invention, two cardboard sections are formed by means of perforations in the cover portion one centrally and the other eccentrically relative to the longitudinal axis thereof, whereby after separating the perforation webs along edges arranged perpendicularly to the tateral edges of the cover portion the carton sections can be bent to form an opening into the interior of the surrounding carton.

BRIEF DESCRIPTION OF THE DRAWINGS

An embodiment of the invention is illustrated by the drawings, wherein show.

DETAILED DESCRIPTION OF THE PREFERRED EMBODIMENTS

Figure 1:
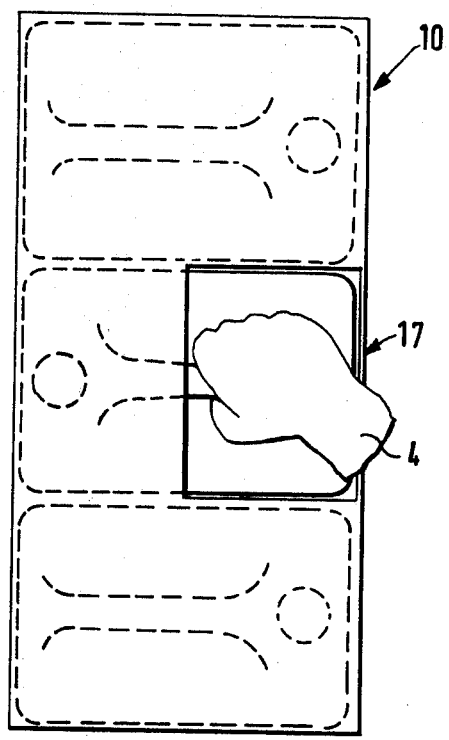
FIG. 1 is a plan view of the surrounding carton according to the invention.
Figure 2:
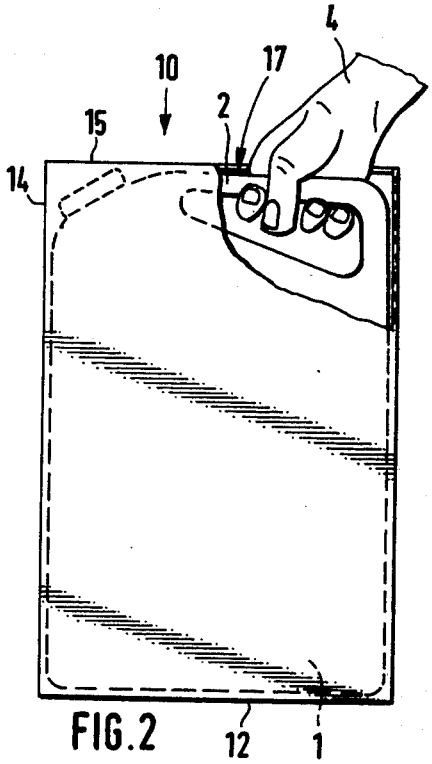
FIG. 2 is a side view of the surrounding carton of FIG. 1.
Figure 3:
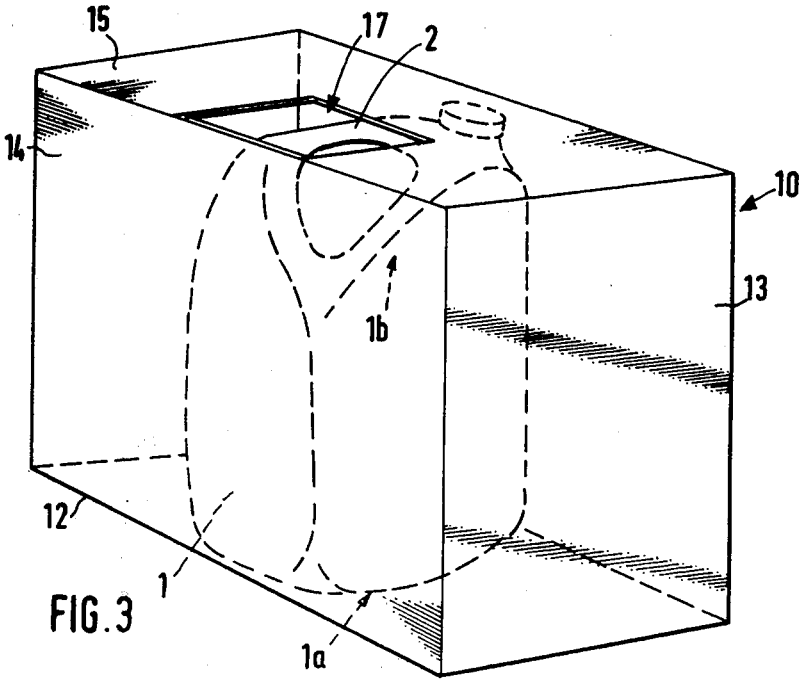
FIG. 3 is a perspective view of the surrounding carton according to FIG. 1.

The surrounding carton 10 comprises a base portion 12, sidewalls 13, 14 and a cover portion 15 and is used to receive an uneven number of containers 1, which have a handle 2 at the end on top section 1*b* remote from base 1*a* (FIGS. 1 to 3). Preferably the surrounding carton 10 is dimensioned in such a way that the containers 1 can be housed in surrounding carton 10 in an immovable and reciprocally supporting manner. In the case of eccentrically arranged handles 2, the containers 1 can be arranged both symmetrically parallel and, to balance the weight, asymmetrically parallel on the base portion 12 of the surrounding carton 10.

A human hand 4 can be passed through opening 17 in the cover portions 15 of the carton 10 for grasping the handle 2 of the central container 1. When the handle 2 of the central container 1 of the uneven number of containers 1 located in carton 10 is grasped, the carton with the transported material can easily be transported in a horizontal position by one person using only one hand and without the carton 10 getting in the way.

The invention is not limited to the embodiment described and shown in the drawing or to a cardboard carton, which material can be replaced by plastics or other suitable materials.

The containers to which reference has been made in the description are preferably per se known, approximately parallelepiped-shaped liquid canisters with a handle, as shown in the drawings. The present invention is applicable more particularly to a surrounding carton holding three canisters each with a 5 liter capacity, because then there is a particularly advantageous matching of the weight and the dimensions. However, it is also possible to have a surrounding carton containing five identical canisters, each with a capacity of 3 to 5 liters, because approximately 15 to 25 kg can easily be managed by one person and cartons of corresponding dimensions can be satisfactorily stacked on pallets of conventional size (80 × 120 cm).

What is claimed is:

1. A packaging unit comprising a plurality of containers in odd numbers, said containers being of the same size and shape, each said container having a bottom, a top and sides extending between said bottom and top, each container including a handle located at least in part on said top thereof, a carton having a rectangular parallelepiped shape and comprising a base, two pair of oppositely disposed side walls secured to and extending upwardly from said base and a cover secured to said side walls, one pair of said side walls being longer than the other pair, said base, side walls and cover defining a closed space for receiving the odd numbers of said containers which are arranged therein in side-by-side relation substantially filling the cross sectional area of the space in said carton parallel with said base thereof and with the bottoms of said containers supported on the base of said carton and with said tops thereof facing upwardly toward and adjacent said cover of said carton, said cover of said carton having an opening therethrough spaced centrally between the shorter of said side walls and the middle one of said containers within said carton having the handle thereon aligned with the opening in said cover and the size of the opening being sufficient to permit a person to to place his hand through said cover to grip said handle aligned therewith for picking up said carton.

2. A packaging unit, as set forth in claim 1, wherein said handles are eccentrically arranged on the tops of said containers relative to the center thereof, said cover having a longer center line and a shorter center line and the opening in said cover being eccentric to the longer central line and symmetrical to the shorter center line.

* * * * *